United States Patent [19]

Focke et al.

[11] 4,267,958

[45] May 19, 1981

[54] HINGE-LID CIGARETTE PACK

[75] Inventors: Heinz Focke; Kurt Liedtke, both of Verden, Fed. Rep. of Germany

[73] Assignee: Focke & Co., Verden, Fed. Rep. of Germany

[21] Appl. No.: 55,206

[22] Filed: Jul. 6, 1979

[30] Foreign Application Priority Data

Jul. 31, 1978 [DE] Fed. Rep. of Germany ..... 2833494

[51] Int. Cl.[3] ..... B65D 5/66; B65D 85/10

[52] U.S. Cl. ..... 229/44 CB; 229/16 A

[58] Field of Search ..... 229/44 CB, 16 A

[56] References Cited

U.S. PATENT DOCUMENTS

| | | | |
|---|---|---|---|
| 2,951,626 | 9/1960 | Weiss | 229/44 CB |
| 2,992,766 | 7/1961 | Guyer | 229/44 CB |
| 3,282,492 | 11/1966 | Vergobbi | 229/44 CB X |
| 3,327,888 | 6/1967 | Chalmers | 229/44 CB X |
| 3,523,636 | 8/1970 | Phillips | 229/44 CB X |
| 3,874,581 | 4/1975 | Fox et al. | 229/44 CB |
| 3,979,047 | 9/1976 | Focke et al. | 229/44 CB |
| 4,196,842 | 4/1980 | Focke et al. | 229/16 A X |

*Primary Examiner*—Davis T. Moorhead

*Attorney, Agent, or Firm*—Sughrue, Rothwell, Mion, Zinn and Macpeak

[57] ABSTRACT

A hinged lid or flip top cigarette pack includes an inwardly stepped or offset collar 29 abutting the top areas of the pack front and side walls. The collar is only joined to the pack by narrow Z-folded residual connections 30, 31 at the opposite ends of the collar front wall 32, the remaining portions being severed by cut lines 36 and 40–42 which define an intermediate reinforcing strip 44. This strip is folded in against the front wall of the pack along a weakened fold line to define a rounded upper pack edge 46, which overlaps with the lower edge of the collar front wall along a narrow zone 47.

9 Claims, 7 Drawing Figures

Figure 1:
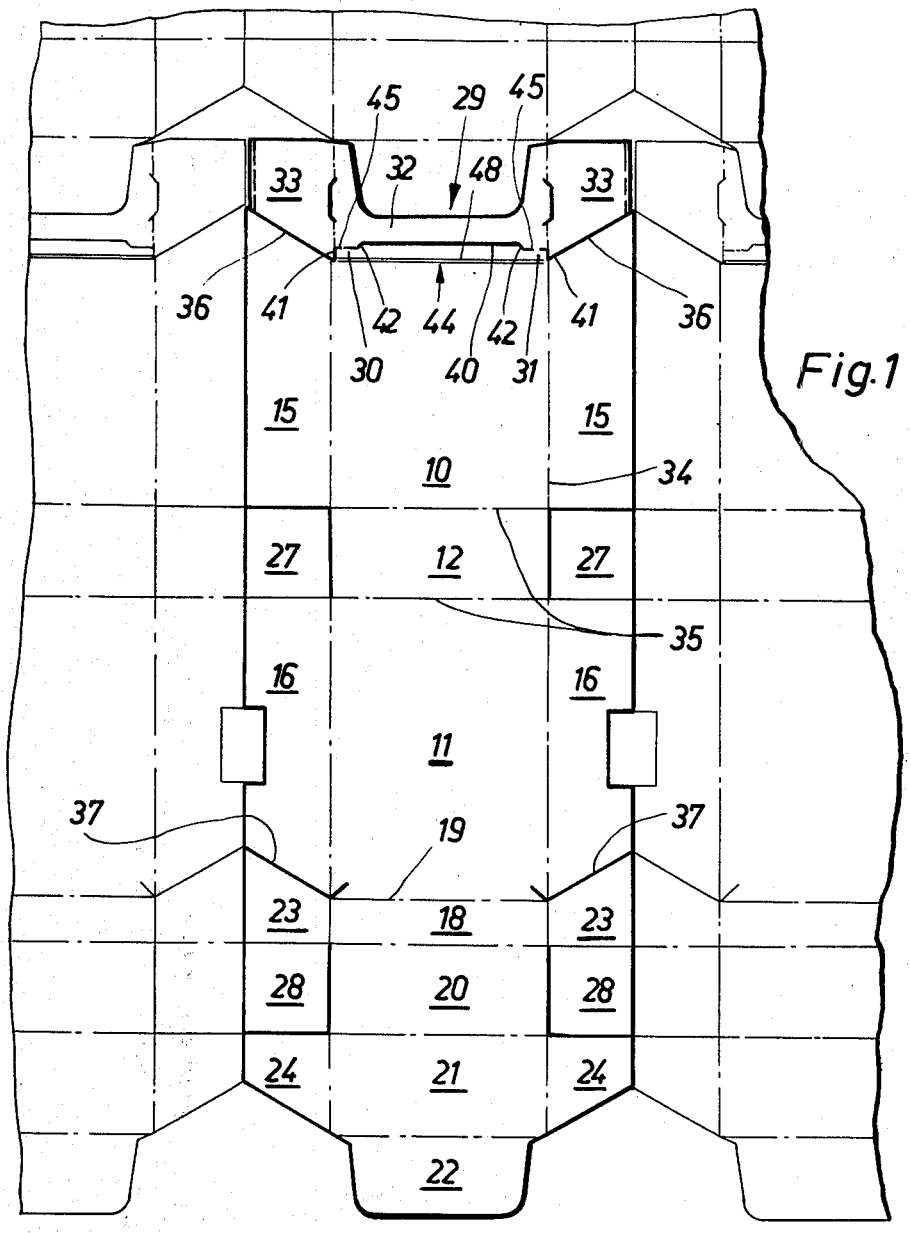

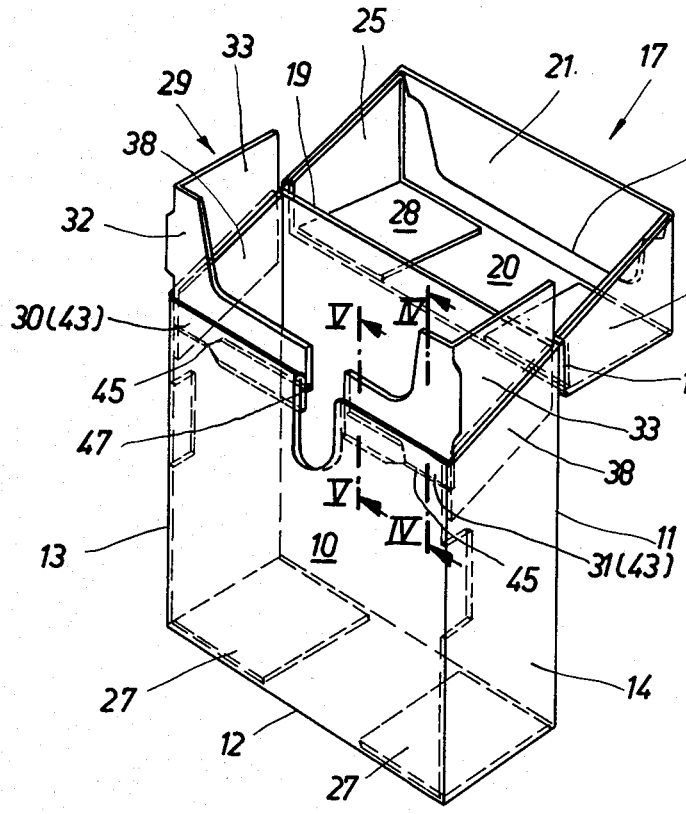
Fig. 3
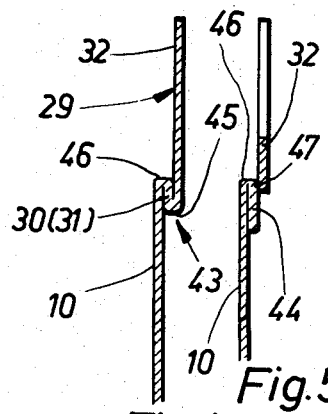
Fig.4
Fig.5
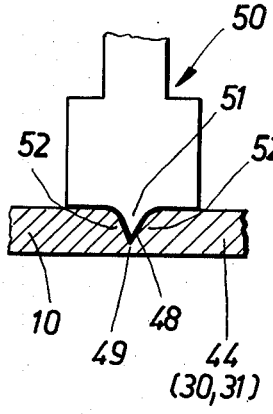
Fig.6
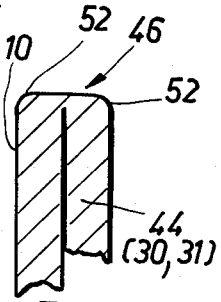
Fig.7

HINGE-LID CIGARETTE PACK

The invention relates to a hinge-lid pack, particularly for cigarettes, comprising a unitary blank having a lid hinged to a rear wall, the lid engaging, in the closed position, around a collar connected to a front wall, the collar, or a collar front wall, being set back inwardly, in the region of the front wall, by a Z-shaped fold (Z-fold) formed from an intermediate strip.

A pack of this kind is disclosed, for example, by German Offenlegungsschrift No. 2,426,131. The complete pack disclosed there comprises a single, unitary blank of paper, board or the like. Consequently, the collar conventionally present in such hinge-lid packs is a part of this blank and is connected to the front wall of the pack. To ensure the stepping, conventionally found in hinge-lid packs of this type, between, on the one hand, the front wall and the side walls of the pack and, on the other hand, the collar and lateral collar tabs, a Z-fold is provided in the known pack, in the region of the front wall and on the side walls, as a connection between the collar and the front wall and side wall. Because of this Z-fold, the collar including its collar tabs is set back by two layers of material relative to the front wall and the side walls. Consequently, the lid, which is also formed of two layers, terminates flush with the front wall and side wall in the closed position.

It is an object of the invention to propose an improved hinge-lid pack of the kind mentioned at the outset, which is of simpler construction, especially as regards economical mechanical manufacture, and in addition provides advantages in respect of handling.

To achieve this object, the hinge-lid pack according to the invention is constructed so that the intermediate strip is separated off, in most of its region, relative to a lower edge of the collar front wall, by a transverse parting cut and is merely connected to the collar by residual connections with a Z-fold, the residual connections being delimited, relative to the collar front wall, by perforation cuts running approximately transversely to the parting cut, the perforation cuts being shorter than the height (width) of the intermediate strip.

The pack construction according to the invention in the region of the connection between the front wall and the collar firstly facilitates mechanical production since a relatively narrow intermediate strip can be folded satisfactorily by mechanical means. Instead of a mechanically difficult Z-fold over the entire width of the front wall, the collar is, in the case of the invention, merely moved relative to the front wall in an offset plane. Z-folds are formed merely in the region of the narrow residual connections. Between these, the intermediate strip is folded over its full width against the inside of the front wall, and rests against the latter. The collar front wall, in turn, rests internally against the folded-over intermediate strip, in the region of an overlap.

As a result of the above construction, the front wall forms, at the transition to the collar or to the collar front wall, a double-layered, rounded edge which is folded over its entire length. At the same time, it is advantageous to facilitate the process of folding over the intermediate strip by providing, in the region of the above-mentioned upper edge, an incision which reduces the cross-section of the material, that is to say a cut which extends over only part of the thickness of the material.

Other features of the invention relate to the constructional design of the pack.

Figure 2:
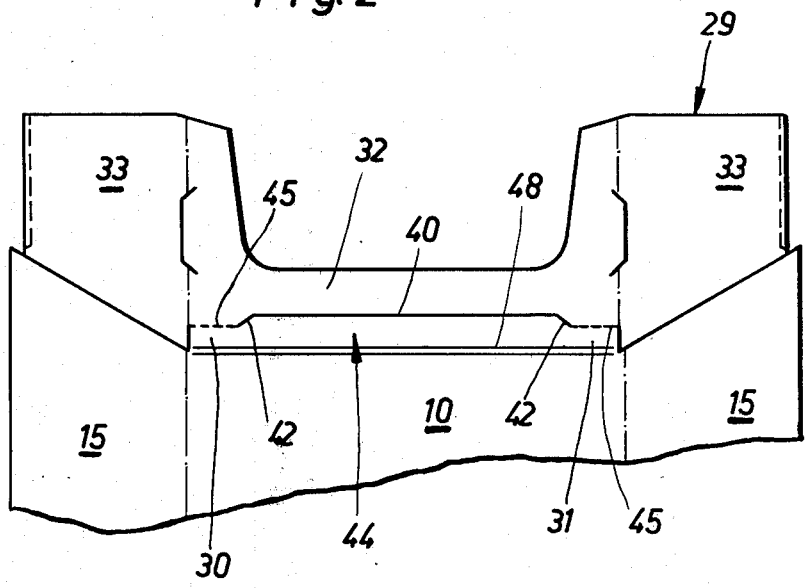

An illustrative embodiment of the hinge-lid pack according to the invention is described in greater detail below with reference to the drawings, in which:

FIG. 1 shows adjacent blanks in a spread-out position,

FIG. 2 shows a region, facing the collar, of a blank according to FIG. 1, on an enlarged scale, FIG. 3 shows a hinge-lid pack made from a blank according to FIG. 1, in perspective view, partly cut away, with the lid open, FIG. 4 shows a cross-section IV—IV in the region of the front wall of the pack, on an enlarged scale, FIG. 5 also shows a cross-section, V—V, in the region of the front wall, FIG. 6 shows a portion of the spread-out blank in the region of a fold edge during the process of reducing the cross-section of the material, on a greatly enlarged scale and FIG. 7 shows the portion according to FIG. 6, after folding over.

The illustrated embodiment of a pack relates to a cuboid hinge-lid pack for cigarettes. This pack comprises the front wall 10, rear wall 11, bottom 12 and side walls 13, 14. The latter are, for the most part, constructed double-layered, that is to say they each consist of side tabs 15 and 16 respectively connected to the front wall 10 and rear wall 11.

A pivotable lid 17 adjoins the upper edge of the rear wall 11. The rear wall 18 of the lid is integrally connected to the rear wall 11 and is pivotable along a fold axis 19.

For the rest, the lid 17 comprises a lid top wall 20, lid front wall 21 and reinforcing tab 22 folded over against the inside of the lid. The lid rear wall 18 and equally the lid front wall 21 are laterally provided with trapezoid lid side tabs 23 and 24 respectively. These matchingly overlap to form the lid side walls 25, 26 which also consist of two layers. Furthermore, corner tabs 27 and 28 are provided in the region of the bottom 12 and the lid 17 respectively, and these rest, respectively, against the bottom 12 and the lid upper wall 20 of the finished pack.

A collar 29 adjoins, in the region of the front wall 10, the pack blank so far described. This collar is integrally connected to the remainder of the blank by residual connections or bridges 30, 31. The collar 29 consists of the collar front wall 32, as a continuation of the front wall 10, and of lateral collar tabs 33 in the region of the adjacent side tabs 15.

The regions of the blank or pack so far described are delimited from one another by longitudinal fold lines 34 and transverse fold lines 35.

The lateral parts of the blank, namely on the one hand, the side tabs 15 and, on the other hand, the collar tabs 33, as well as, on the one hand, the side tabs 16 and, on the other hand, the lid side tabs 23 are separated from one another, over their full width, by inclined parting cuts 36, 37. As a result of the inclined position (about 30°) of the parting cuts 36, 37, correspondingly inclined closing edges of the pack and of the lid, and a lower inclined edge of the collar tabs 33 result.

The blank described above is folded in a known manner, by the longitudinal folding method, to form the pack according to FIG. 3. The folding of the lid 17 is conventional, whilst special features are provided in the region of the collar 29.

The lateral collar tabs 33 are embedded and anchored, in particular by glueing, in the upper region between the side tabs 15, 16 of the side walls 13, 14 by means of a lower anchoring strip 38 which can, for example, have a height of about 5 mm. Alternatively, the layers can also be stacked in such a way that the lateral collar tabs 33 rest entirely against the inside of the side walls 13 and 14 of the pack.

The connection between the collar 29 and front wall 10 is of special construction. In the present illustrative embodiment, lateral residual connections 30 and 31, of narrow width, are provided. Outside the region of these residual connections 30, 31, the collar 29 or the collar front wall 32 is separated from the front wall 10 by a transverse parting cut 40. The residual connections 30, 31 which here rest against the rim of the front wall 10 are separated from the externally adjoining regions of the collar 29, namely the collar tabs 33, by lateral incisions 41.

At the sides of the residual connections 30, 31 which face the external side cuts 41, these residual connections are delimited by shorter, offset perforation cuts 42. These perforation cuts 42, which here run at an angle, that is to say are inclined, adjoin the ends of the transverse parting cut 40. The free ends of the perforation cuts 42 lie at the same height as the facing ends of the side cuts 41. The connection of these ends at the same time provides lower foldlines 45 for the residual connections 30, 31 when forming a Z-fold 43 in this region.

In producing the pack, the collar 29 is pushed into a set-back plane by a movement relative to the front wall 10, in such a way that the residual connections 30, 31 are folded over against the rear face of the front wall 10. The residual connections 30, 31 are part of an imaginary intermediate strip 44 which forms the connection between the front wall 10 and the collar front wall 32. Outside the region of the residual connections 30, 31, the intermediate strip 44 rests folded-over against the inside of the front wall 10. The intermediate strip 44 is delimited from the front wall 10 by an upper fold edge 46 over the full width of the pack. This fold edge 46, which as a result is double-layered, at the same time is the closing edge of the pack in the region of the front face. It closes flush with the lid front wall 21, which is also double-layered.

The dimensions are advantageously so chosen that the intermediate strip 44 outside the region of the residual connections 30, 31 has twice the width of the inner arm of the Z-folds 43, for example has a width or height of 5 mm. As a result, the Z-fold 43 has relatively small dimensions. Nevertheless, stable constructional circumstances prevail, because the intermediate strip 44 which rests against the inner face of the front wall 10 forms a reinforcement.

In forming the Z-folds 43, the collar front wall 32 is brought against the inside of the folded-over intermediate strip 44. In the region between the residual connections 30, 31, the collar front wall 32 makes contact by means of an overlap 47 having a height or width of, for example, 1 mm. The residual connections 30, 31 and the perforation cuts 42 must be matched to one another in dimensions in such a way as to ensure an overlap 47 of a certain minimum width. The intermediate strip 44 can furthermore be connected to the front wall 10, and the collar front wall 32 can be connected to the intermediate strip 44, by glueing or the like.

To facilitate the folding-over of the intermediate strip 44 when forming the Z-folds 43, the blank is, as shown in FIGS. 6 and 7, provided in the region of the fold edge 46 with an incision 48 which preferably extends over the whole width of the pack. This incision is made from the outside of the blank, in such a way that in this region the material suffers a reduction in cross-section, for example so as to leave residual material 49 which has $\frac{1}{3}$ of the original material thickness.

The incision 48 is made with a special parting tool 50, whose blade 51 is V-shaped, with a rounded transition to the remaining region of the parting tool 50. As a result, rounded cut edges 52 are produced on either side of the incision 48. These rounded cut edges 52 result in a fold edge 46 which is rounded overall when the parts of the blank which are delimited from one another by the incision 48, in the present instance the front wall 10 and the intermediate strip 44, are folded over through 180° to rest against one another. This special technique of reducing the thickness of the material in the region of fold edges can also be utilised in other ways, that is to say in other pack constructions.

Instead of the incision 48 described above, a reduction in material thickness, facilitating the folding process, can be effected in the region of the fold edge 46 by local, namely linear, compression of the blank. For this it is possible to use a pinching tool, the cross-section of which approximately corresponds to that of the parting tool 50, with the difference that the lower cutting edge is rounded. As a result of the shape of such a pressing or pinching tool, a substantially V-shaped channel or groove is impressed in the material, which groove facilitates the process of folding to form a fold edge 46, and can also possess rounded edges resembling the cut edges 52. Such a "folding aid" can also be employed elsewhere, especially where relatively narrow or small regions of a blank have to be folded.

We claim:

1. A hinge-lid cigarette pack folded from a unitary blank and including a lid hinged to a rear wall of the pack, the lid surrounding and engaging in its closed position an upstanding collar inwardly set back from a front and opposite side walls of the pack, characterized by:

(a) the collar being directly connected to the blank only by a pair of narrow residual connecting bridges (30, 31) disposed at opposite ends of a front wall (32) of the collar and extending to corresponding opposite ends of the upper edge of the front wall (10) of the pack, (b) an elongated intermediate reinforcing strip (44) disposed in the open blank between the upper edge of the front wall of the pack and a lower edge of the collar front wall and defined by a transverse separating cut (40) extending between and above the connecting bridges and a pair of angled perforation cuts (42) individually extending from opposite ends of the separating cut to transverse fold lines (45) on the bridges, (c) the height of each perforation cut measured transverse to the length of the intermediate reinforcing strip being less than the width of the strip, and (d) the collar and intermediate reinforcing strip being Z-folded inwardly about the upper edge of the front wall of the pack and the transverse fold lines, with the strip lying against the inner surface of the upper front wall portion of the pack and engaging the lower edge of the collar front wall.

2. A hinge-lid pack as claimed in claim 1, wherein the perforation cuts extend over about half the width of the intermediate strip (44).

3. A hinge-lid pack as claimed in claim 2, wherein the collar front wall overlaps, outside the region of the residual connecting bridges, against the inner face of the folded over intermediate strip.

4. A hinge-lid pack as claimed in claim 1, wherein the residual connecting bridges are each separated from laterally adjoining parts of the blank by lateral cuts (41).

5. A hinge-lid pack as claimed in claim 1, wherein the collar front wall is connected to the folded over intermediate strip by glueing.

6. A hinge-lid pack as claimed in claim 1, wherein, in the region of an upper fold edge (46) between the front wall and the intermediate strip, there is an incision (48) which reduces the thickness of the blank material and extends across said upper fold edge.

7. A hinge-lid pack as claimed in claim 6, wherein the incision is so configured that after folding the upper fold edge forms rounded cut edges (52).

8. A hinge-lid pack as claimed in claim 7, wherein the incision has a V-shaped cross-section with rounded cut edges.

9. A hinge-lid pack as claimed in claim 1, wherein, in the region of an upper fold edge (46) between the front wall and the intermediate strip, there is a notch resulting from the compression of the blank material which reduces the thickness of the material, extends across said upper fold edge, and has a V-shaped cross-section and rounded edge regions.

* * * * *